US006001458A

United States Patent [19]

Heir et al.

[11] Patent Number: 6,001,458

[45] Date of Patent: Dec. 14, 1999

[54] NETTING

[76] Inventors: Geoffrey Michael Heir, 37 Rapaki Road, Christchurch; Wayne Eric Dolheguy, Bayoons Road, RD 2, Kaiapoi; Ian David Sutton, 468 Linwood Avenue, Christchurch, all of New Zealand

[21] Appl. No.: 08/991,443

[22] Filed: Dec. 16, 1997

[30] Foreign Application Priority Data

Dec. 16, 1996 [NZ] New Zealand ..... 299953

[51] Int. Cl.[6] ..... B32B 3/06; B32B 7/00

[52] U.S. Cl. ..... 428/193; 428/192; 442/50

[58] Field of Search ..... 428/192, 193; 442/50, 52

[56] References Cited

U.S. PATENT DOCUMENTS

| | | | |
|---|---|---|---|
| 2,313,581 | 3/1943 | Reed | 428/193 X |
| 4,113,907 | 9/1978 | Haage et al. | 428/193 X |
| 4,455,337 | 6/1984 | Lloyd et al. | 442/50 X |
| 5,501,894 | 3/1996 | Lagemann et al. | 428/193 X |
| 5,546,196 | 8/1996 | Robinson et al. | 428/192 X |
| 5,637,379 | 6/1997 | Lagemann et al. | 428/193 |

*Primary Examiner*—Daniel Zirker

*Attorney, Agent, or Firm*—Young & Thompson

[57] ABSTRACT

A netting having a longitudinal direction and a transverse direction. There is a first part intended to be substantially horizontal in use having at least two portions. The portions are being mutually longitudinally aligned. At least one portion has apertures of a larger size than apertures in at least one other portion. The second part comprises a flap connected or connectable to the first part at or adjacent one edge of the second part and at or adjacent the portion of larger opening size in the first part.

20 Claims, 3 Drawing Sheets

NETTING

FIELD OF THE INVENTION

This invention relates to netting and in particular to the type of netting frequently described as hail netting.

BACKGROUND OF THE INVENTION

Known hail netting has a number of portions, for example, a pair of side portions with relatively closely woven configuration, that is to say with relatively small apertures and a central area of larger aperture size is known. The closely woven area is placed over, for example, plants and the area of larger aperture size is positioned between rows of plants so that hail falling over the plants will be substantially prevented from passing through the netting and will tend to move towards the central area where it will fall to ground through the larger apertures thereby reducing the weight of hail on the net at any one time.

Although such hail netting provides substantial protection to the plants when the hail is falling substantially vertically the netting provides less protection where the hail is coming at an angle to the vertical. Thus for example hail which is blown by substantial wind can pass through the central aperture and still damage the plants or fruits carried thereon. We believe that the hail netting is also able to be subjected to a number of other improvements.

SUMMARY OF THE INVENTION

It is therefore an object of the present invention to provide netting which will obviate or minimize the foregoing disadvantage in a simple yet effective manner and will go at least some way towards meeting the foregoing desiderata in a simple yet effective manner, or which will at least provide the public with a useful choice.

Accordingly in one aspect the invention consists in netting having a longitudinal direction and a transverse direction comprising a first part intended to be substantially horizontal in use having at least two portions, the portions being mutually longitudinally aligned, at least one portion having apertures of a larger size than apertures in at least one other portion, and a second part being a flap connected or connectable to the first part at or adjacent one edge of the second part and at or adjacent the portion of larger opening size in the first part.

Preferably, three portions are provided the portions being aligned longitudinally along the netting and the central area being of a larger opening size than the portions each side of the central portion.

Preferably, the material of the flap is of a smaller aperture size.

Preferably, the flap is up to substantially 300 mm in width.

Preferably, the smaller aperture size is such as to restrict or substantially prevent passage of hail therethrough and the larger aperture size is to substantially allow passage of hail therethrough.

Preferably, the flap is positioned substantially centrally of the larger aperture size area.

Preferably, each edge of the larger aperture is substantially three times the length of the edge of the smaller apertures.

Preferably, the flap is constructed during manufacture of the netting.

Preferably, the netting is knitted from filaments, and the flap is knitted into the netting.

Alternatively, the flap is attached subsequent to the manufacture of the netting.

Preferably, clips are provided for attaching or positioning the flap relative to the first part.

Preferably, the netting has a selvedge at the edges thereof and the selvedge includes or has adjacent thereto eyelets.

Preferably, the eyelets are knitted in during manufacture.

Preferably, at least some filaments are electrically resistive to provide heating wires.

Preferably, said netting indicates a year of manufacture.

Preferably, the year of manufacture is indicated by means of coloured filaments knitted into the net so that a particular colour or combination of colours indicates a year of manufacture.

Preferably, the colour filament or filaments are provided at the edges of the netting.

Preferably, the net is marked to indicate where clips should be positioned.

Preferably, marking is provided at the edge of the net and/or the edge of the central portion and/or the centre of the central portion.

Preferably, the netting is marked at intervals along its length such as lengths for example of about 10 meters.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE DRAWINGS

One preferred form of the invention and modifications thereof will now be described with reference to the accompanying drawings in which.

DETAILED DESCRIPTION OF THE INVENTION

Figures 1, 2:
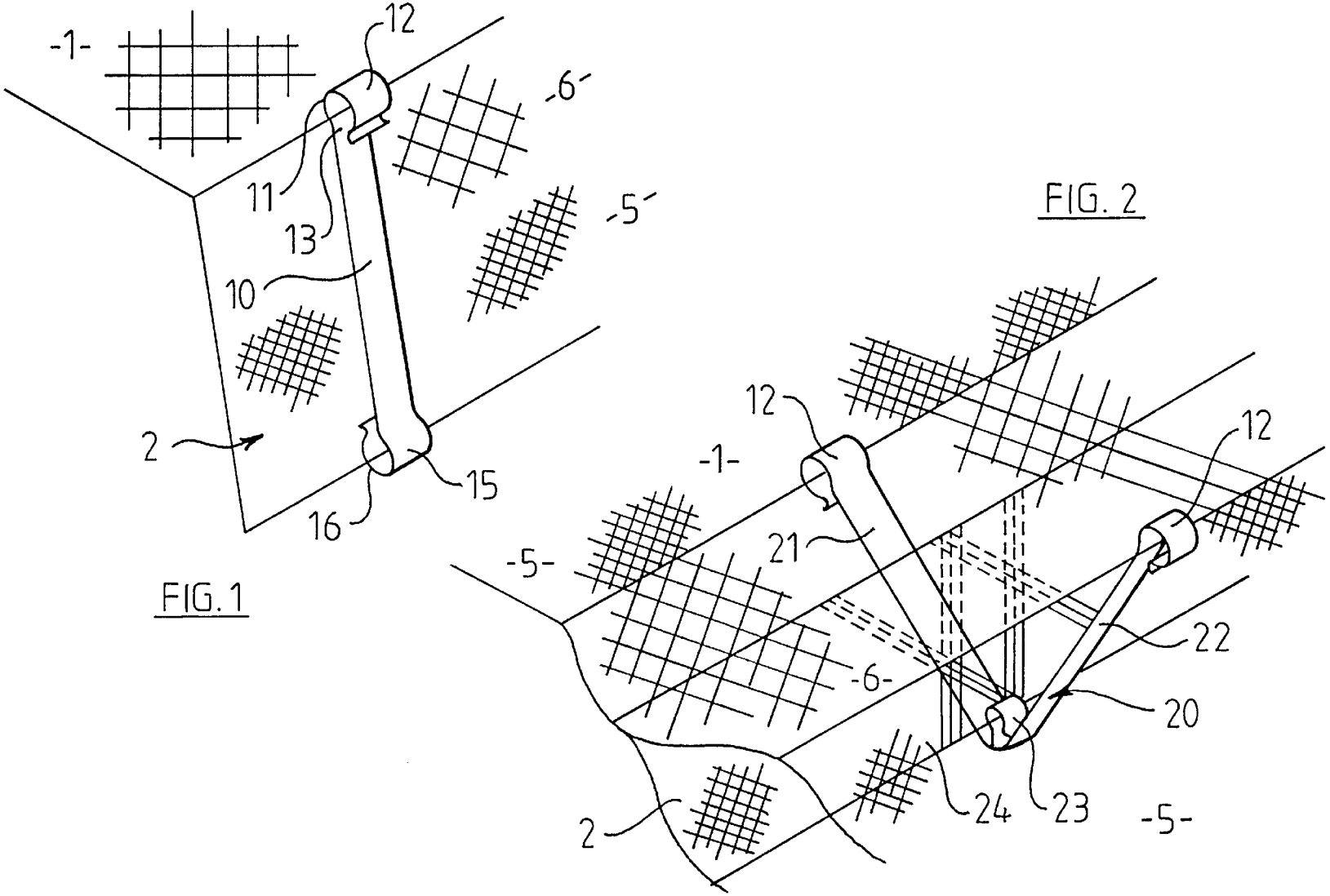
FIG. 1: is a diagrammatic perspective view of part of netting according to the invention showing a fixing clip.
FIG. 2: is a view as in FIG. 1 showing an alternatively fixing clip.

Referring to the drawings hail netting is provided as follows.

Referring to FIGS. 1 and 2 the net comprises a first part 1 which in use is intended to lie substantially horizontally and a second part 2 which in use would normally be substantially vertical, usually downwardly depending from the first part.

The part 1 includes at least two and usually three portions. Thus there are a pair of portions 5 and a second portion 6. In the preferred construction a first portion 5 is provided along each edge of the netting and being of sufficient width when the netting is in an expanding position to cover selected plants and the central portion 6 being of sufficient width to meet the requirements for example about 10 centimeters. The purpose of the portion 6 is to allow hail to fall to the ground between rows of plants.

The netting may be knitted and to this end ribs are provided at 7 to form apertures. The apertures may be crossed by further filaments 8 so as to provide an aperture size through which hail will not readily pass. The portion 6 which is usually central does not have the filaments 8 and in the preferred form the aperture size of an aperture 9 is such that when compared to an aperture 10 in the area 5 the edge 11 is substantially 3 times the length of an edge such as edge 12. The particular relationship of the edges is not crucial but it is intended that the apertures 9 be substantially larger than the apertures 10.

The part 2 which is in the form of a flap may be formed of any suitable material but desirably is formed of the same material provided in the portions 5 of the part 1. That is to say hail will not readily pass through the flap 2. The flap 2 may be knitted in the construction or alternatively may be formed in a separate knitting operation and attached to the material in the part 1 for example by sewing, binding rings, connecting clips or in any other suitable manner.

Figure 3:
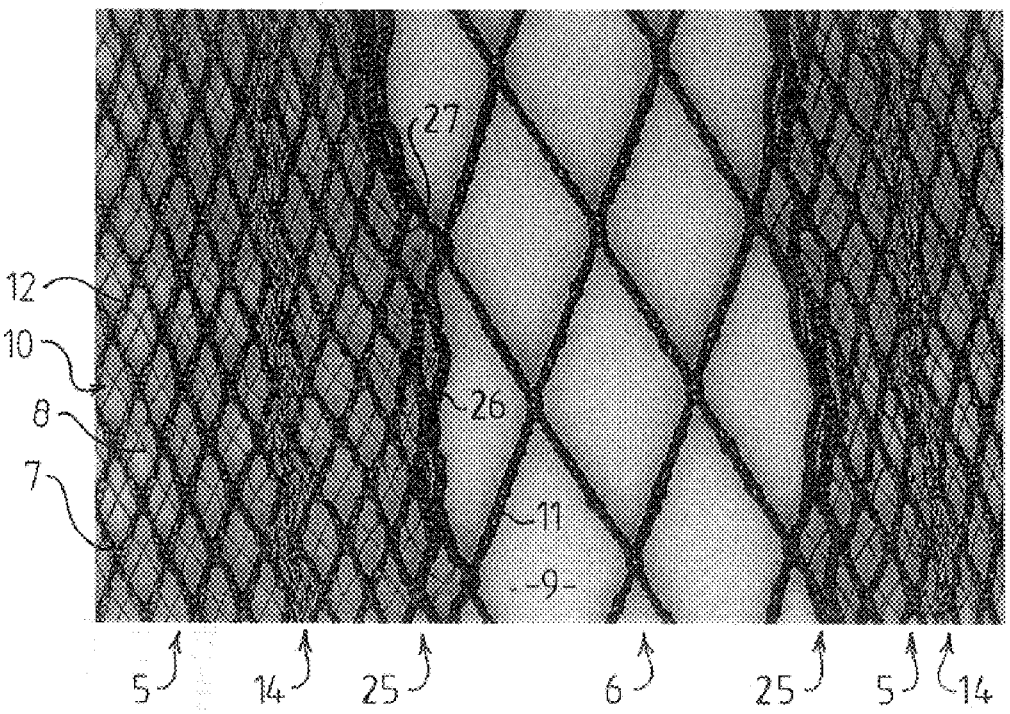
FIG. 3: is a plan view showing essential portion of netting according to one preferred form of the invention.
Figure 4:
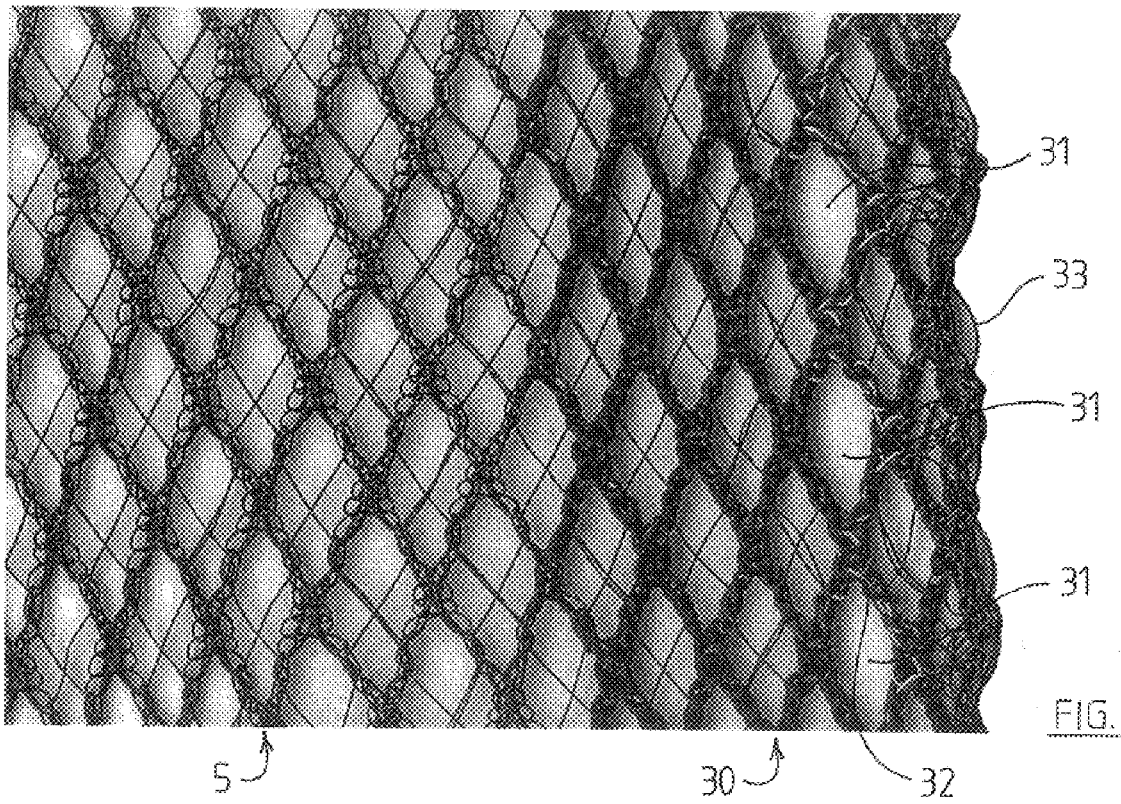
FIG. 4: is a plant view showing an edge portion of netting according to one preferred form of the invention.

It is desirable that the flaps be stabilized and this can be achieved by a clipping system. FIGS. 1 and 2 show alternative clips but other clips could be used. In FIG. 1 the clip is provided by a substantially rigid length of material 10 although the clip may have some flexibility being formed for example of a substantially rigid plastics material or formed from shaped galvanized tin or in some other suitable manner. At one end 11 the material is reversed on itself at 12 so as to provide a narrow opening 13. This is engaged with the netting material at any suitable position and for example a suitable position can be marked at 14 for example by use of a filament in the knitting of a different colour as can be seen in FIG. 3. The knitting can be arranged so that eyelets are provided at this point into which the clip can be positioned if desired. At the other end 15 of the clip again a clipping arrangement 16 is provided which can engage the bottom edge of the flap 2 to hold the flap in a somewhat taut position. A number of such clips are provided spread along the length of the flap for example at about every 60 centimeters or so but in any event sufficient for the needs.

The clip 20 in FIG. 2 has a pair of arms 21 and 22 forming a V shape with clips 12 at the upper end of each which can be clipped into the part 1 for example as above described. In the crook of the V an upstanding hook 23 is provided which can engage the bottom edge 24 of the material substantially as in FIG. 1. An advantage of a clip of this type is that the flap is somewhat stabilized horizontally as well as held taut. Clips are mounted at suitable distances for example every 600 centimeters or so. The knitting is preferably provided so that in the region 25 of the part 5 adjacent the region 6 the ribs such as ribs 26 and 27 have extra material therein to increase the strength of the netting in that region thereby reducing the risk of tearing or the like.

Other improvements can be made.

For example along the outer edges a selvedge 30 may be provided, and into the selvedge may be provided a number of eyelets 31 which will enable the net to be mounted on a suitable support structure for example by providing a suitable clip between the support structure which engages into the eyelets 31. Again the position of the eyelets can be indicated by providing a filament 32 of a contrasting colour.

It is also desirable to provide an identification on the netting to provide in particular ready information as to the year of manufacture. This can suitably be provided by providing a filament 33 desirably at the edge of the construction again in a contrasting colour so that a number of colours can be provided one for each year over a selected period of time. Thus for example the colour orange may indicate the year 1996, the colour green 1997 and so on.

Furthermore if desired a marking may be provided for example at a selected length such as every 10 meters which could be provided for example by a spray paint device during manufacture or otherwise as desired simply to provide a ready indication of length. It is also desirable to package the netting in a manner that it can be readily withdrawn from the package, for example by packing the material in a zigzag formation or accumulated formation in the container The vertical (in use) dimension of the flap will depend on the dimensions of the width of the central area 6 and other factors such as the label of wind expected and the like, but we believe that a depth of about 300 millimeters would in most cases be satisfactory.

In an alternative construction a flap could be provided at each edge of the central area 6.

In use the flap in the construction will prevent a substantial quantity of hail coming in obliquely to the net from striking fruit for example on the plants. This will reduce any tendency for hail damage to the fruit. It is a particular advantage that the flap will not cause any substantial obstacle to hail falling through the larger apertures directly to the ground as can occur for example if a cross piece of material is suspended below the part 6.

The other features described herein also enhanced the use in practice of the netting material.

What we claim is:

1. Netting comprising:

a first part intended to be substantially horizontal in use, and having at least two portions which are mutually longitudinally aligned; said at least two portions including at least one first portion and a second portion; said first portion having apertures of a larger size than apertures in the second portion; and a second part in the form of a flap, which in use is intended to be substantially vertical and downwardly depending from the first part; said second part adapted to be connected to the first part adjacent one edge of the second part and adjacent said at least one first portion.

2. Netting as claimed in claim 1, wherein said at least two portions comprise three portions including a central portion having apertures of a larger opening size than the apertures in the portions on each side of the central portion, said three portions being aligned longitudinally along the netting.

3. Netting as claimed in claim 1, wherein the flap is made of a material having an aperture size smaller than the apertures of the first portion.

4. Netting as claimed in claim 1, wherein the flap has a width of approximately 300 mm.

5. Netting as claimed in claim 1, wherein smaller size apertures in the second portion substantially prevent passage of hail therethrough, and the apertures of larger size allow passage of hail therethrough.

6. Netting as claimed in claim 1, wherein the flap is positioned substantially centrally of said first portion.

7. Netting as claimed in claim 1, wherein each edge of the larger apertures has a length which is substantially three times the length of an edge of the smaller apertures.

8. Netting as claimed in claim 1, wherein the flap is constructed during manufacture of the netting.

9. Netting as claimed in claim 8, wherein the netting is knitted from filaments, and the flap is knitted into the netting.

10. Netting as claimed in claim 9, wherein at least some filaments are electrically resistive to provide heating wires.

11. Netting as claimed in claim 1, wherein the flap is attached subsequent to manufacture of the netting.

12. Netting as claimed in claim 11, further comprising clips for attaching the flap relative to the first part.

13. Netting as claimed in claim 12, wherein the netting includes a marking to indicate where the clips should be positioned.

14. Netting as claimed in claim 13, wherein the marking is provided at at least one of an edge of the netting, an edge of a central portion, and a center of the central portion.

15. Netting as claimed in claim 1, wherein the netting has a selvedge at the edges thereof, and the selvedge includes eyelets.

16. Netting as claimed in claim 15, wherein the eyelets are knitted in during manufacture.

17. Netting as claimed in claim 1, wherein said netting indicates a year of manufacture.

18. Netting as claimed in claim 17, wherein the year of manufacture is indicated by means of colored filaments knitted into the netting.

19. Netting as claimed in claim 18, wherein the colored filaments are provided at the edges of the netting.

20. Netting as claimed in claim 1, wherein the netting is marked at substantially equally spaced intervals along its length.

* * * * *